US005448987A

United States Patent [19]

Jang

[11] Patent Number: 5,448,987

[45] Date of Patent: Sep. 12, 1995

[54] KITCHEN SMOKE EXHAUSTER

[76] Inventor: Sun-Sing Jang, 650, Yuan-Huan E. Rd., Fong-Yuan, Taichung, Taiwan

[21] Appl. No.: 328,012

[22] Filed: Oct. 24, 1994

[51] Int. Cl.[6] ..... F24C 15/20

[52] U.S. Cl. ..... 126/299 R; 126/299 D

[58] Field of Search ..... 126/299 R, 299 D, 299 F, 126/300; 55/DIG. 36; 454/46, 66, 237, 252

[56] References Cited

U.S. PATENT DOCUMENTS 3,295,433 1/1967 Fox et al. ..... 126/299 D
4,462,387 7/1984 Welsh ..... 126/299 R
4,738,244 4/1988 Welsh ..... 126/299 R
5,320,088 6/1994 Nester ..... 126/299 R

*Primary Examiner*—James C. Yeung
*Attorney, Agent, or Firm*—Browdy and Neimark

[57] ABSTRACT

A smoke exhauster is provided under a bottom plate thereof with two first locating members, two second locating members, and a lower plate. The lower plate is located by two first locating members and two second locating members such that the front side, the left side and the right side of the lower plate form a smoke-drawing space along with the bottom side of the bottom plate. The size of the smoke-drawing space is such that the fume can be effectively exhausted by the smoke exhauster.

4 Claims, 4 Drawing Sheets

KITCHEN SMOKE EXHAUSTER

BACKGROUND OF THE INVENTION

The present invention relates generally to a smoke exhauster, and more particularly to a kitchen smoke exhauster.

As shown in FIG. 1, a kitchen smoke exhauster 10 of the prior art comprises a fan 11 for generating a suction force, which draws the cooking fume into the bellows via a main smoke-drawing hole 121 of the bottom plate 12. It is a well-known fact that the cooking fume rises in a funnel-shaped manner. The suction force of the main smoke-drawing hole 121 can reach only the periphery of the main smoke-drawing hole 121. As a result, the cooking fume in the front side of the bottom plate 12 is not drawn into hole 121 and is allowed to escape into the kitchen air.

SUMMARY OF THE INVENTION

It is therefore the primary objective of the present invention to provide a kitchen smoke exhauster capable of overcoming the shortcoming of the prior art smoke exhauster described above. Accordingly, the kitchen smoke exhauster of the present invention is provided with a greater smoke-drawing range so as to minimize the escape of the cooking fume into the kitchen air.

The present invention may best be understood through the following description with reference to the accompanying drawings, in which:

DETAILED DESCRIPTION OF THE EMBODIMENT

Figure 1:
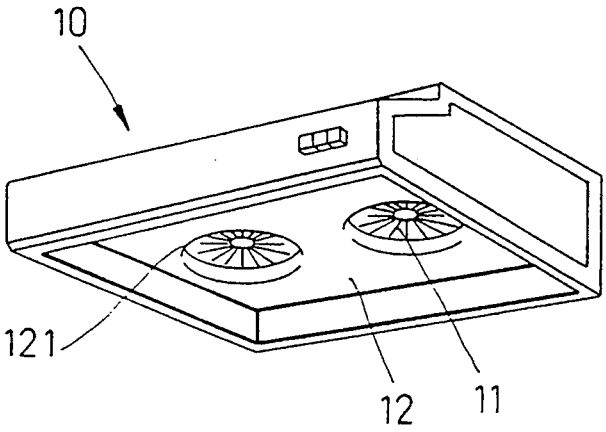
FIG.1 (PRIOR ART)
FIG. 1 shows a perspective view of a kitchen smoke exhauster of the prior art.
Figure 2:
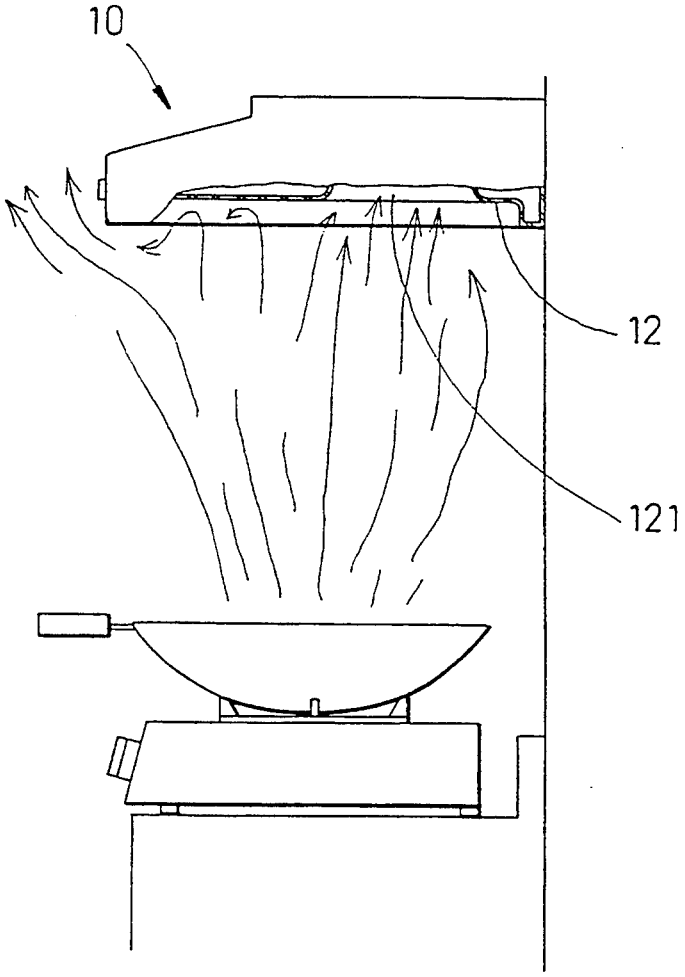
FIG.2 (PRIOR ART)
FIG. 2 shows a schematic view of the prior art kitchen smoke exhauster at work.
Figure 3:
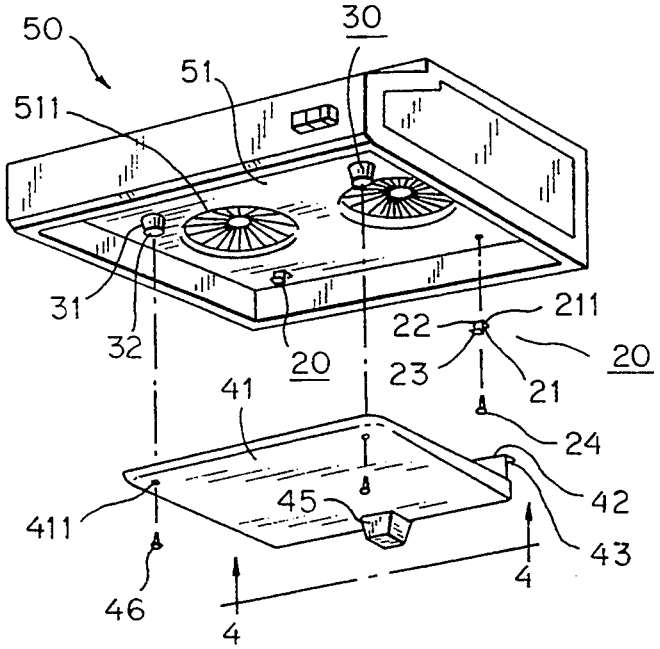
FIG. 3 shows an exploded view of a kitchen smoke exhauster of the present invention.
Figure 4:
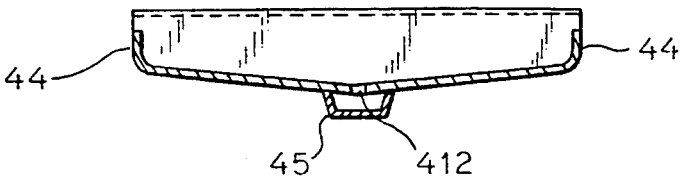
FIG. 4 shows a sectional view of a portion taken along the line 4—4 as shown in FIG. 3.
Figure 5:
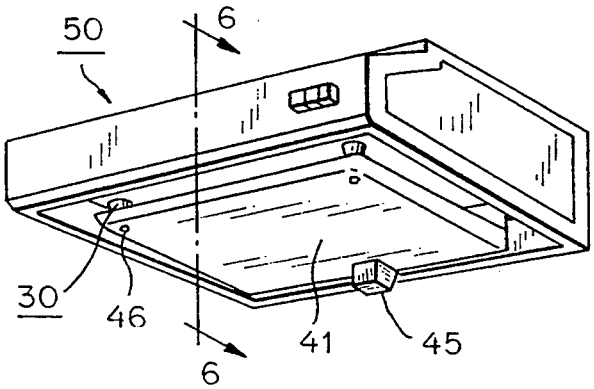
FIG. 5 shows a perspective view of the kitchen smoke exhauster of the present invention.
Figure 6:
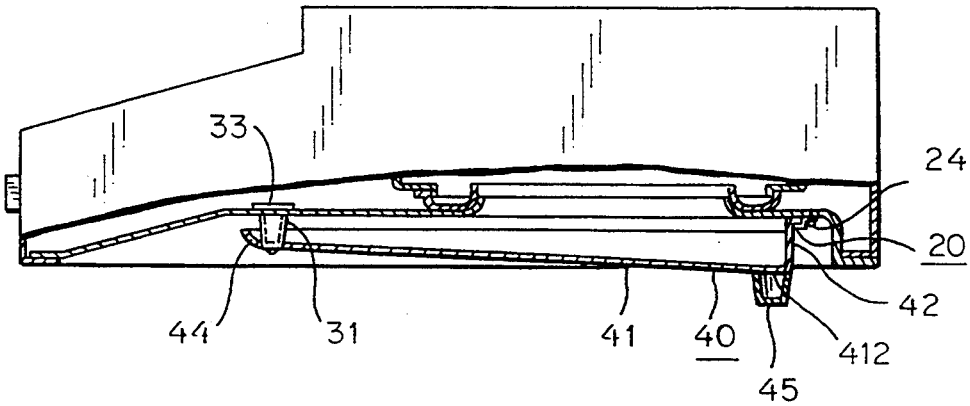
FIG. 6 shows a sectional view of a portion taken along the line 6—6 as shown in FIG. 5.

As shown in FIGS. 3–6, a kitchen smoke exhauster according to the present invention comprises two first locating members 20, two second locating members 30, and a lower plate 40.

The two first locating members 20 are arranged respectively at both sides of the rear section of a bottom plate 51 of the smoke exhauster 50. The first locating members 20 are made of a highly heat-resistant material. The two first locating members 20 are provided with a first horizontal plate 21 which is in turn provided at the front edge thereof with a vertical plate 22 extending downwards and having at the bottom edge thereof a second horizontal plate 23 extending forward. The first horizontal plate 21 is provided with a through hole 211 engageable with a screw 24. This permits, the first horizontal plate 21 to be fastened securely to the underside of the bottom plate 51 by means of the screw 24 which is engaged with the through hole 211 of the first horizontal plate 21.

The two second locating members 30 are arranged respectively at both sides of the front segment of the bottom plate 51. Each of the two second locating members 30 has a cylindrical portion 31 which is sealed off at the bottom thereof with a bottom piece 32 and is provided on the top edge thereof with a projected ring 33 (see FIG. 6), which is fastened to the upper side of the bottom plate 51 by welding. The cylindrical portion 31 is put through a through hole of the bottom plate 51 from the upper side of the bottom plate 51 such that the projected ring 33 of the cylindrical portion 31 is fastened to the bottom plate 51. The bottom piece 32 is provided with a threaded hole.

The lower plate 40 is provided with a main plate 41 having a front portion and a rear portion which is lower in level than the front portion. The main plate 41 is provided on the rear edge thereof with a back plate 42 extending upwards and having on the top edge thereof a short strip 43 extending rearwards. The main plate 41 is provided respectively on the front edge thereof, the left edge thereof and the right edge thereof with an arcuate portion 44 extending upwards. The main plate 41 is further provided respectively in both sides of the front segment thereof with a small hole 411. The main plate 41 is still further provided at the center of the rear side thereof with a through hole 412 which is located at the lowest point of the center and is provided with an oil collecting cup 45. In combination, both sides of the short strip 43 are located respectively over the second horizontal plates 23 of the two first locating members 20. The lower plate 40 is fastened to the second locating members 30 by means of two fastening screws 46 which are engaged respectively with the two small holes 411 of the main plate 41 and the two threaded holes of the two second locating members 30.

Figure 7:
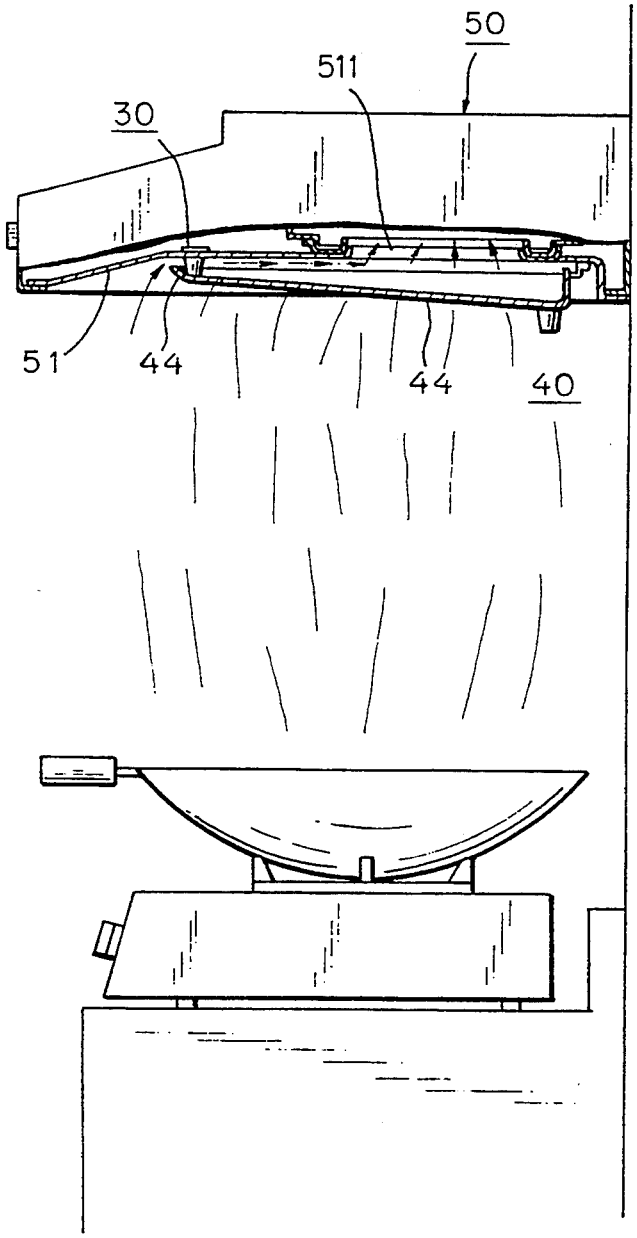
FIG. 7 shows a schematic view of the present invention in action.

As illustrated in FIG. 7, the cooking fume is entirely drawn into the space which is formed by the front side, the left side and the right side of the lower plate 40 and the bottom side of the bottom plate 51. The cooking fume is then guided to flow into the bellows via a main smoke-drawing hole 511. It is therefore apparent that the smoke exhauster of the present invention is provided with a relatively greater smoke-drawing range capable of exhausting effectively the cooking fume which rises in a funnel-shaped manner.

While the invention has been described in connection with what is presently considered to be the most practical and preferred embodiments, it is to be understood that the invention is not to be limited to the disclosed embodiments but on the contrary, is intended to cover various modifications and equivalent arranged included within the spirit and scope of the appended claims which scope is to be accorded the broadest interpretation so as to encompass all such modifications and equivalent structures.

What is claimed is:

1. A smoke exhauster comprising a bottom plate, two first locating members, two second locating members, and a lower plate engaged under and to the bottom plate by the two first locating members and the two second locating members;

wherein said two first locating members are located respectively at both sides of a rear segment of said bottom plate, each said two first locating members having a first horizontal plate having on a front edge thereof a vertical portion extending downwards, said vertical portion having on a bottom edge thereof a second horizontal plate extending forward, said first horizontal plate being fastened to an underside of said bottom plate;

wherein said two second locating members are located respectively at both sides of a front segment of said bottom plate, each of said second locating member having a cylindrical portion having a bottom which is sealed off with a bottom piece provided with a threaded hole, said cylindrical portion further having a top edge which is fastened to said bottom plate; and wherein said lower plate is provided with a main plate having a front portion and a rear portion said main plate further having on a rear edge thereof a back plate extending upwards, said back plate having on a top edge thereof a short strip extending rearwards, said main plate still further having respectively on a front edge thereof, a left edge thereof and a right edge thereof an arcuate plate extending upwards, said main plate provided respectively in both sides of a front segment thereof with a small hole, said main plate further provided at a center of a rear side thereof with a through hole which is located at a lowest point of said center and is provided with an oil collecting member said lower plate fastened to said two second locating members by two fastening screws engageable with said small hole of said main plate and said threaded hole of said second locating members such that said short strips of said main plate are located respectively over said second horizontal plate of said two first locating members, and that a top of said arcuate plate is separated from an underside of said bottom plate by an appropriate distance, and wherein the front portion of said main plate is higher than said rear portion.

2. The smoke exhauster according to claim 1 wherein said first horizontal plate of said first locating member is provided with a through hole engageable with a fastening screw which is in turn engaged with a threaded hole located at a rear segment of said bottom plate.

3. The smoke exhauster according to claim 1 wherein said cylindrical portion of said second locating members is provided on a top edge thereof with a projected ring; and wherein said cylindrical portion of said second locating members is put through a through hole of said bottom plate and said projected ring of said cylindrical portion is fastened to said bottom plate by welding.

4. The smoke exhauster according to claim 2 wherein said cylindrical portion of said second locating members is provided on a top edge thereof with a projected ring; and wherein said cylindrical portion of said second locating members is put through a through hole of said bottom plate and said projected ring of said cylindrical portion is fastened to said bottom plate by welding.

* * * * *